United States Patent [19]

Wilson et al.

[11] 4,031,034

[45] June 21, 1977

[54] ALTERING PERFUME GREEN NOTES USING TRITHIOACETONE

[75] Inventors: Richard Arnold Wilson, Westfield; Ira Katz, West Long Branch; Manfred H. Vock, Locust, all of N.J.; Edward J. Shuster, Brooklyn, N.Y.

[73] Assignee: International Flavors & Fragrances Inc., New York, N.Y.

[22] Filed: Mar. 1, 1976

[21] Appl. No.: 662,819

Related U.S. Application Data

[63] Continuation-in-part of Ser. No. 528,461, Nov. 29, 1974, abandoned, which is a continuation-in-part of Ser. No. 166,683, July 28, 1971, abandoned.

[52] U.S. Cl. ..... 252/522; 260/327 R; 260/327 T; 424/76

[51] Int. Cl.[2] ..... C11B 9/00

[58] Field of Search ..... 252/522; 260/327 R, 260/327 T

[56] References Cited

UNITED STATES PATENTS 2,213,804 9/1940 Lincoln et al. ..... 260/327 R

*Primary Examiner*—Veronica O'Keefe

*Attorney, Agent, or Firm*—Arthur L. Liberman; Harold Haidt; Franklin D. Wolffe

[57] ABSTRACT

Perfume and fragrance compositions, and perfumed articles comprising trithioacetone having the structure:

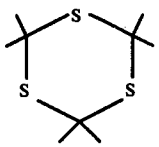

are described.

2 Claims, No Drawings

ALTERING PERFUME GREEN NOTES USING TRITHIOACETONE

This application is a continuation-in-part of U.S. application for Letters Patent Ser. No. 528,461 filed on Nov. 29, 1974, now abandoned, which, in turn, is a continuation-in-part of U.S. application for Letters Patent Ser. No. 166,683 filed on July 28, 1971, now abandoned.

BACKGROUND OF THE INVENTION

There is a continuing search for materials having desirable fragrance properties. Such materials are sought either to replace costly natural materials or to provide new fragrances or perfume types which have not heretofore been available. Especially desirable qualities for substances having interesting fragrances are stability and persistence in a wide variety of perfumed articles and perfume compositions, ease of manufacture, and intensity of aroma.

Crushed leaf and green-leafy notes with tomato-like undertones are particularly desirable for many uses in conjunction with perfumes and perfumed compositions and articles, particularly for topnotes for "geranium" type perfumes, e.g. "Geranium Bourbon."

The prior art discloses little if any use of sulfur-containing compounds in perfumery, particularly because of the breakdown of such compounds to form low molecular weight, noxious organic sulfur-containing compounds. However, U.S. Pat. No. 2,213,804 issued on Sept. 3, 1940, states at page 3, line 2 and page 3 lines 6–10 that 1,3-dithiane having the structure:

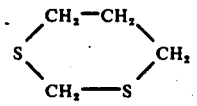

and 2,2-dimethyl-1,3-dithiane having the structure:

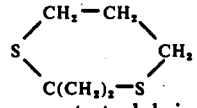

are useful addition agents to lubricating oils and that such compounds may be "too odoriferous" for certain purposes. At page 3, column 1, lines 64–68, it is further stated:

> "In such cases the odor is covered by a suitable perfuming agent. Such details of practice will be apparent to anyone skilled in the art."

Thus, although not stated to be useful per se in perfumery, the use of such materials in conjunction with other perfume materials is disclosed in U.S. Pat. No. 2,213,803. However, there is no teaching in U.S. Pat. No. 2,213,804 that the compound used in practicing the instant invention, trithioacetone, has a crushed leaf note and a leafy-green note with tomato-like undertones and is useful in perfumery particularly as a topnote for geranium type perfumes.

THE INVENTION

It has now been discovered that perfume formulations, perfumed materials and perfumed articles having crushed leaf notes and leafy-green notes with tomato-like undertones, particularly for providing a topnote for geranium perfume compositions, may be provided by adding trithioacetone (2,2,4,4,6,6-hexamethyl-s-trithiane) having the structure:

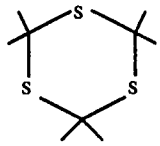

to perfume and fragrance modifying materials or to materials to be fragranced (e.g., soaps or detergents).

It has been found that the trithioacetone of this invention possesses crushed leaf note and a leafy-green note with tomato-like undertones with good intensity and persistance, and this fragrance quality particularly adapts the trithioacetone for incorporation into perfume compositions and fragrance modidying compositions having desirable geranium or geranium bourbon aromas. It will be appreciated by those skilled in the art from the present disclosure that the fragrance character of the finished perfume compositions can be tailored to specific uses; as more fully described hereinafter.

The trithioacetone as an olfactory agent can be incorporated into a wide variety of compositions which will be enhanced by any one of the crushed leaf notes or green leafy notes which it possesses. The trithioacetone can be added to perfume compositions in its pure form or it can be added to mixtures of materials in fragrance-imparting compositions to provide a desired fragrance character to a finished perfume material. The perfume and fragrance character to a finished perfume material. The perfume and fragrance compositions obtained according to this invention are suitable in a wide variety of perfumed articles and can also be used to enhance, modify or reinforce natural fragrance materials. It will thus be appreciated that the trithioacetone of this invention is useful as an olfactory agent and fragrance.

The term "perfume composition" is used herein to mean a mixture of compounds, including, for example, natural oils, synthetic oils, alcohols, aldehydes, ketones, esters, lactones and frequently hydrocarbons which are admixed so that the combined odors of the individual components produce a pleasant or desired fragrance. Such perfume compositions usually contain (a) the main note or the "bouguet" or foundation-stone of the composition; (b) modifiers which round-off and accompany the main note; (c) fixatives which include odorous substances which lend a particular note to the perfume throughout all stages of evaporation, and substances which retard evaporation; and (d) top-notes which are usually low-boiling, fresh-smelling materials. Such perfume compositions of this invention can be used in conjunction with carriers, vehicles, solvents, dispersants, emulsifiers, surface-active agents, aerosol propellants, and the like.

In perfume compositions the individual components contribute their particular olfactory characteristics, but the overall effect of the perfume composition will be at least the sum of the effects of each ingredient. Thus, the trithioacetone of this invention can be used alone or in combination to alter the aroma characteristics of a perfume composition; for example by high-lighting or moderating the olfactory reaction contributed by another ingredient of the composition.

The amount of trithioacetone of this invention which will be effective in perfume compositions depends on many factors, including the other ingredients, their amounts and the effects which are desired. It has been found that perfume compositions containing as much as 10% or as little as 0.05% by weight of the trithioacetone of this invention, or even less can be used to impart a crushed leaf note or a green leafy note with a tomato-like undertone to soaps, cosmetics, and other products. The amount employed will depend on considerations of cost, nature of the end product, the effect desired in the finished product, and the particular fragrance sought.

The trithioacetone disclosed herein can be used alone in a fragrance-modifying composition, or in a perfume composition as an olfactory component in detergents and soaps, space deodorants; perfumes; colognes; bath preparations such as bath oil, bath salts; hair preparations such as lacquers, brilliantines, pomades and shampoos; cosmetic preparations such as creams, deodorants, hand lotions, sun screens; powders such as talcs, dusting powders, face powder and the like. When he trithioacetone of this invention is used in perfumed articles such as the foregoing, it can be used in an amount of 0.1% or lower. Generally it is preferred not to use more than about 10% in the finished perfumed article since the use of too much will tend to unbalance the total aroma and will needlessly raise the cost of the article.

The following examples serve to illustrate embodiments of the invention as it is now preferred to practice it. It will be understood that these examples are illustrative and the invention is to be considered restricted thereto only as indicated in the appended claims.

EXAMPLE I

PREPARATION OF PERFUME COMPOSITION CONTAINING TRITHIOACETONE (2,2,4,4,6,6-HEXAMETHYL-TRITHIANE)

The following composition is prepared:

| Ingredients | Parts by Weight |
|---|---|
| 2,2,4,4,6,6-hexamethyl-s-trithiane (trithioacetone) | 4 |
| Benzyl butyrate | 4 |
| Bois de Rose | 10 |
| Citronellyl formate | 30 |
| Citronellyl acetate | 20 |
| Geraneol coeur | 200 |
| Citronellol coeur | 300 |
| Menthone | 5 |
| Menthol natural | 5 |
| Rose oxide | 10 |
| Geranyl acetate | 30 |
| Dimethyl Benzylcarbinyl-acetate | 2 |
| | 620 |

The addition of 2,2,4,4,6,6-hexamethyl-s-trithiane in the quantity given imparts a green leafy note similar to that of natural geranium bourbon to the composition without detracting from the quality of the odor.

EXAMPLE II

PREPARATION OF SOAP COMPOSITION

One hundred grams of soap chips are mixed with one gram of the perfume composition of Example I until a substantially homogeneous composition is obtained. The perfumed soap composition manifests an excellent geranium bourbon character with green leafy notes.

EXAMPLE III

PREPARATION OF A DETERGENT COMPOSITION

A total of 100 grams of a detergent powder is mixed with 0.15 grams of the perfume composition of Example I until a substantially homogeneous composition is obtained. This composition has an excellent geranium bourbon aroma with green leafy notes and crushed leaf notes and a tomato-like undertone.

EXAMPLE IV

PREPARATION OF A COSMETIC POWDER COMPOSITION

A cosmetic powder is prepared by mixing in a ball mill 100 grams of talcum powder with 0.25 grams of the perfume composition of Example I. It has an excellent geranium bourbon aroma with green leafy and crushed leaf nuances and a tomato-like undertone.

EXAMPLE V

PERFUMED LIQUID DETERGENT

Concentrated liquid detergents with a rich geranium bourbon character are obtained containing 0.10%, 0.15% and 0.20% of the perfume composition of Example I. They are prepared by adding and homogeneously mixing the appropriate quantity of perfume formulation of Example I in the liquid detergent. The detergents all possess a geranium bourbon aroma with excellent green leafy nuances, the intensity of the aroma and green leafy nuances increasing with greater concentrations of perfume composition of Example I.

EXAMPLE VI

COLOGNE AND HANDKERCHIEF PERFUME

The perfume composition of Example I is incorporated in a cologne at a concentration of 2.5% in 85% aqueous ethanol; and into a handkerchief perfume at a concentration of 5% (in 95% aqueous ethanol). A distinct and definite geranium bourbon fragrance with excellent green leafy, crushed leaf nuances is imparted to the cologne and to the handkerchief perfume.

EXAMPLE VII

PREPARATION OF SOAP COMPOSITION

One hundred grams of soap chips are admixed with 0.5 grams of trithioacetone until a substantially homogeneous composition is obtained. The perfumed soap composition exhibits an excellent green leafy aroma with a tomato-like undertone.

EXAMPLE VIII

PREPARATION OF A DETERGENT COMPOSITION

A total of 100 grams of a detergent powder is mixed with 0.05 grams of trithioacetone until a substantially homogeneous composition is prepared. This composition exhibits an excellent crushed leaf, green leafy aroma.

EXAMPLE IX

PREPARATION OF A COSMETIC POWDER COMPOSITION

A cosmetic powder is prepared by mixing in a ball mill 100 grams of talcum powder with 0.15 grams of trithioacetone It has an excellent crushed leaf, green leafy aroma with tomato-like undertones.

EXAMPLE X

PERFUMED LIQUID DETERGENT

Concentrated liquid detergents with a rich green leafy and crushed leaf aroma are obtained containing 0.10%, 0.15% and 0.20% of trithioacetone. They are prepared by adding and homogeneously mixing the appropriate quantity of trithioacetone in the liquid detergent. The detergents all possess rich green leaf and crushed leaf aromas, the aroma intensity increasing with greater concentrations of trithioacetone.

EXAMPLE XI

COLOGNE AND HANDKERCHIEF PERFUME

Trithioacetone is incorporated in a cologne at a concentration of 2.5% in 85% aqueous ethanol; and into a handkerchief perfume at a concentration of 3% (in 95% aqueous ethanol). A distinct and definite green leafy, crushed leaf fragrance is imparted to the cologne and to the handkerchief perfume.

What is claimed is:

1. A process for altering, modifying or enhancing the crushed-leaf notes and leafy green notes of a perfume or a cologne which comprises adding thereto from 0.05% up to 10% by weight of trithioacetone.

2. The process of claim 1 wherein the composition altered, modified or enhanced is a perfume composition.

* * * * *